US008616436B2

(12) United States Patent
Brewer

(10) Patent No.: US 8,616,436 B2
(45) Date of Patent: Dec. 31, 2013

(54) CURBSIDE MAIL PROTECTION MAILBOXES

(71) Applicant: Tafforest Brewer, Bloomington, IL (US)

(72) Inventor: Tafforest Brewer, Bloomington, IL (US)

( * ) Notice: Subject to any disclaimer, the term of this patent is extended or adjusted under 35 U.S.C. 154(b) by 0 days.

(21) Appl. No.: 13/739,140

(22) Filed: Jan. 11, 2013

(65) Prior Publication Data

US 2013/0175332 A1 Jul. 11, 2013

Related U.S. Application Data

(60) Provisional application No. 61/585,567, filed on Jan. 11, 2012.

(51) Int. Cl.
*B65G 11/04* (2006.01)

(52) U.S. Cl.
USPC ..... 232/29; 232/45

(58) Field of Classification Search
USPC ..... 232/45, 17, 24, 25, 29, 33; 220/23.87, 220/23.89; 206/515
See application file for complete search history.

(56) References Cited

U.S. PATENT DOCUMENTS

| | | | | | |
|---|---|---|---|---|---|
| 755,038 | A | * | 3/1904 | Palmer | 232/24 |
| 2,945,621 | A | * | 7/1960 | Kopprasch et al. | 232/24 |
| 4,333,603 | A | * | 6/1982 | Carlson | 232/17 |
| 4,361,271 | A | * | 11/1982 | Hester et al. | 232/17 |
| 4,726,512 | A | | 2/1988 | White | |
| 5,407,126 | A | | 4/1995 | Coultas et al. | |
| 5,915,618 | A | | 6/1999 | Gaudet | |
| 6,375,070 | B1 | | 4/2002 | Snoke | |
| 6,808,108 | B1 | | 10/2004 | Turnbow et al. | |
| 7,070,090 | B2 | | 7/2006 | Ranen | |
| 7,931,189 | B2 | | 4/2011 | Kalenburg | |

* cited by examiner

*Primary Examiner* — William Miller
(74) *Attorney, Agent, or Firm* — Patent Clinic of JMLS

(57) ABSTRACT

A mailbox system includes a mailbox housing having an interior chamber. The interior chamber has a surface area and a depth. A lockbox is securely coupled to the mailbox housing, and the lockbox is disposed in the interior chamber of the mailbox housing. A security door is hingeably attached to a wall of the lockbox. The security door has a size smaller than that of the surface area of the interior chamber of the mailbox housing. A lock assembly is coupled to the security door, and the lock assembly is configured to alternatively maintain the security door in a closed position or an opened position.

11 Claims, 6 Drawing Sheets

PRIOR ART

PRIOR ART

CURBSIDE MAIL PROTECTION MAILBOXES

CROSS-REFERENCE TO RELATED APPLICATIONS

This is a nonprovisional application of the provisional application Ser. No. 61/585,567, filed on Jan. 11, 2012, entitled "An object inside the mail box to provide identity and mail protection," which application is hereby incorporated herein by reference in its entirety.

TECHNICAL FIELD

Embodiments of the invention relate generally to a secure construction of and modification to a mailbox placed by the curbside in front of residences.

BACKGROUND

Mailboxes provide easy access for a mail carrier to deposit a mail item. In particular, curbside mailboxes placed in front of households in subdivisions and neighborhoods across America are particularly convenient to both the mail carrier and the mail recipients because they provide convenient deposit and retrieval of mail items. However, over the years, these conveniences have been abused. The rise of identity theft makes these curbside mailboxes an easy target. The current construction of curbside mailboxes typically does not include any security measures, such as an exemplary mailbox 100 illustrated in FIG. 1. For example, such security measure as locks or any theft prevention measure is absent from the mailbox 100. These mailboxes typically provide an easy-to-open door facing the street with a flag on the side of the mailbox (not shown) indicating there are mail items to be picked up.

With the simple construction, identity thieves easily target specific mail items in these mailboxes. Mail items such as boxes of checks, financial account summaries, credit cards, debit cards, and other credit information continue to be delivered by mail. As such, identity thieves or even nosy neighbors could effortlessly open the easy-to-open door to retrieve these identity sensitive items. In other words, as the door of the mailbox 100 is opened, the interior of the mailbox 100 is available in plain view. As such, in many situations, identity theft victims frequently didn't realize that they were victims until days, weeks, months, or years later.

SUMMARY

Aspects of the invention provide an improvement to current mailbox constructions and designs without altering the overall look of the existing mailboxes. Embodiments of the invention further enable current users to apply the improved apparatus to their existing mailboxes without replacing them. Embodiments of the invention provide a secured lockbox inside the housing of an existing mailbox. For example, the lockbox provides a chamber to house mail items. In addition, embodiments of the invention provide two keys to open the lockbox; a master key for the mail carrier to open the lockbox in order to deposit mail items during his or her routine mail drop. The other key, which is specific to the owner of the mailbox, to open the lockbox to retrieve mail items therefrom. There are no open slots or other openings.

In one embodiment, a mailbox system includes a mailbox housing having an interior chamber. The interior chamber includes a surface area and a depth. A lockbox is securely coupled to the mailbox housing and the lockbox is disposed in the interior chamber of the mailbox housing. A security door is hingeably attached to a wall of the lockbox. The security door has a size smaller than that of the surface area of the interior chamber of the mailbox housing. The system also includes a lock assembly coupled to the security door, and the lock assembly is configured to alternatively maintain the security door in a closed position or an opened position.

Another embodiment of the invention includes a mailbox apparatus having a lockbox securely coupled to a mailbox housing. The lockbox is disposed in an interior chamber of the mailbox housing. A security door is hingeably attached to a wall of the lockbox, and the security door has a size smaller than that of a surface area of the interior chamber of the mailbox housing. A lock assembly is coupled to the security door. The lock assembly is configured to alternatively maintain the security door in a closed position or an opened position. The apparatus also includes a first key for enabling the lock assembly and a second key for enabling the lock assembly.

A further embodiment of the invention includes a secure mailbox system having a plurality of housings. Each of said plurality housings has an interior chamber. The interior chamber has a surface area and a depth. A plurality of lockboxes with each of said plurality of lockboxes securely coupled to each of the plurality of housings. Each of the plurality of lockboxes is disposed in the interior of each of the plurality of the housings. A plurality of security doors with each of said plurality of security doors hingeably attached to a wall of the each of the plurality lockboxes. Each of the plurality of security doors has a smaller area than that of the surface area of the interior chamber of the each of the plurality of housings. The system also includes a plurality of lock assemblies with each of said plurality of lock assemblies being coupled to the each of the plurality of security doors. Each of said plurality of lock assemblies is configured to alternatively maintain the each of the plurality of the security doors in a closed position or an opened position. The system further includes a first key for operably enabling the plurality of lock assemblies.

BRIEF DESCRIPTION OF THE DRAWINGS

Corresponding reference characters indicate corresponding parts throughout the drawings.

DETAILED DESCRIPTION

Figure 2:
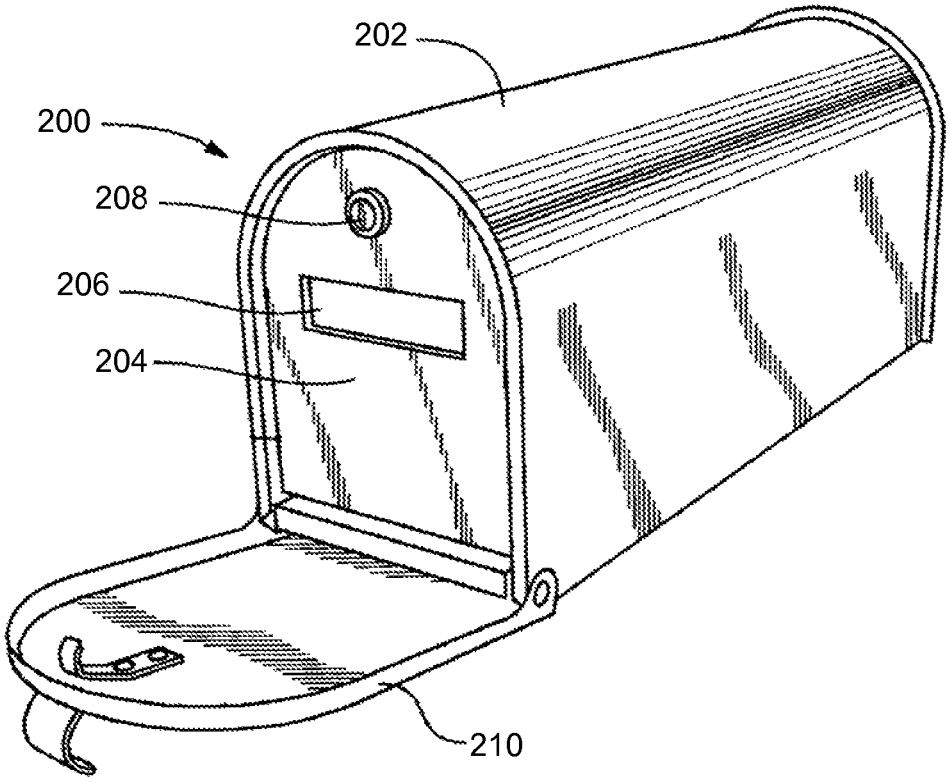
FIG. 2 illustrates a perspective view of another mailbox according to prior art.

Referring to FIG. 2, an illustration of a prior art mailbox 202. In particular, the mailbox 202 includes a housing 202 and a door 210. The mailbox 200 further includes a secondary door 204 disposed inside the mailbox 200. The secondary door 208 includes a mail drop opening 206 and a lock 208. This prior art design of the mailbox 200, while provides a measure of the security, still exposes the mail items of the mailbox owner to identity theft through the opening 206. Identity thieves could either use a tool to pry open the lock 204 or use a tool to pick out mail items inside the mailbox 202.

Figure 1:
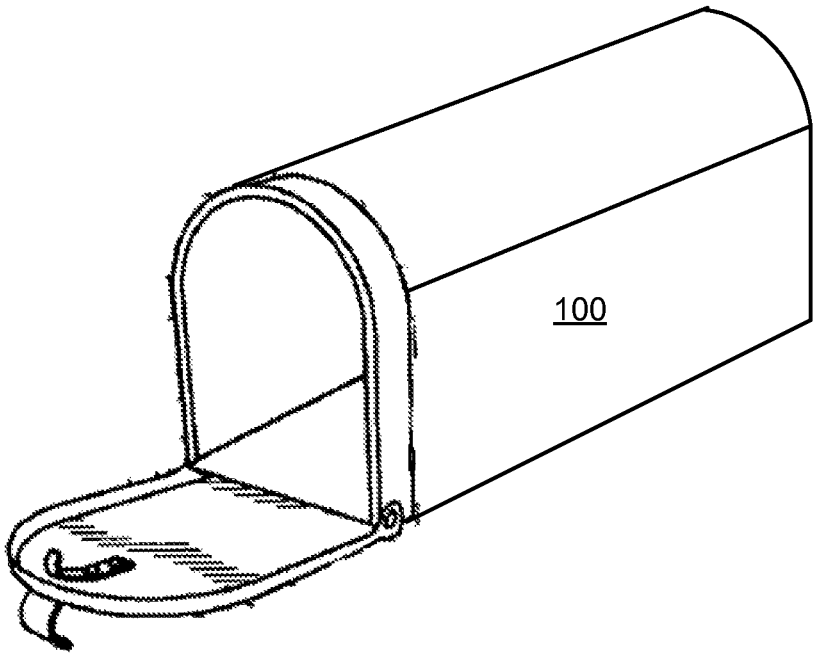
FIG. 1 illustrates a perspective view of an exemplary mailbox according to prior art.
Figure 3:
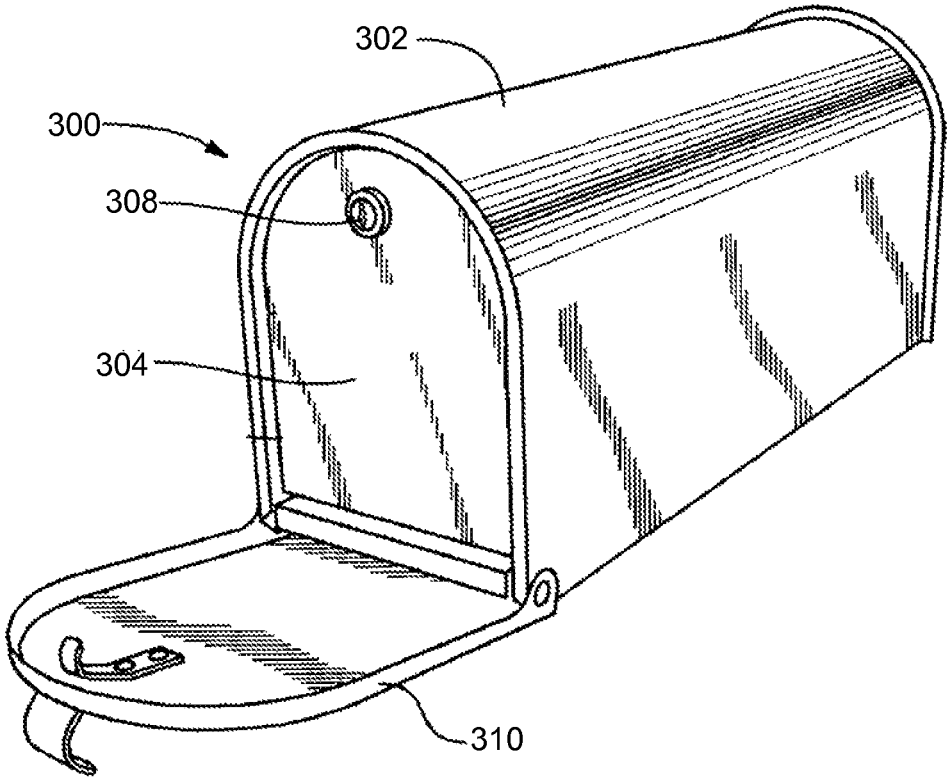
FIG. 3 illustrates a perspective view of a mailbox according to one embodiment of the invention.

As such, in overcoming the shortcomings of the prior art, embodiments of the invention provide an improved mailbox as illustrated in FIG. 3. A mailbox 300 in FIG. 3 appears to be a normal or standard mailbox as the mailbox 100 of FIG. 1 and the mailbox 200 of FIG. 2. The mailbox 300 provides a housing 202 having an interior chamber (not shown) for receiving a lockbox 304. For example, the interior chamber includes a surface area and a depth. For instance, the surface area may be measured in square inch, and the depth may be measured in inches. It is to be understood that other measuring units may be used without departing from the scope and spirit of the invention.

Figure 4:
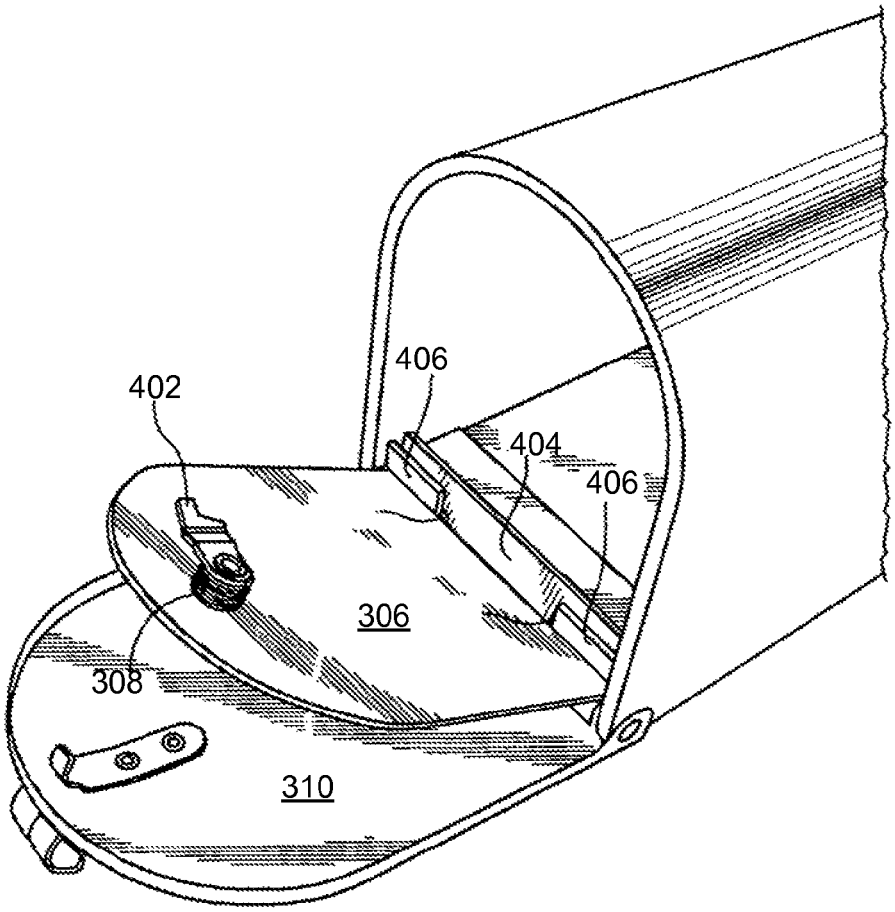
FIG. 4 illustrates a perspective view of a mailbox with a door of a lockbox disposed in the mailbox open according to one embodiment of the invention.

The lockbox 304 includes a security door or a door 306, shown in FIG. 4, is coupled to the lockbox 304. Referring now to FIG. 4, the door 306 is hingeably attached to or connected with the lockbox 304. In one example, the door 306 includes an inside surface perpendicular to an interior of the lockbox such that the door 306 swings out of the lockbox in an open position. In one example, a hinge assembly (504 and 506) is secured to the door 306 and the lockbox 304. For example, the hinge assembly is secured to the door 306 and the lockbox 304 via fasteners, such as screws. As shown in FIG. 3, the door 306 is secured to a wall or a bottom edge of the lockbox 304. In another embodiment, the door 306 may be secured to other edges of the lockbox 304 without departing from the scope and spirit of the invention. Furthermore, other types of hinge assembly may be employed without departing from the scope and spirit of the invention.

Referring to FIG. 3 again, the mailbox 300 includes a lock assembly 308 coupled to the door 306. In one embodiment, the lock assembly 308 is configured to alternatively maintain the door 306 in a closed position or an opened position. For example, FIG. 3 illustrates the door 306 in the closed position with the lock assembly 308 engaged with the lockbox 304. In another example, FIG. 4 illustrates the door 306 in the opened position with the lock assembly 308 disengaged with the lockbox 304. Moreover, FIG. 4 illustrates a tongue 402 as an exemplary part of the lock assembly 308. Other types of lock assemblies may be used for the lock assembly 308 without departing from the scope and spirit of the invention.

As clear shown in FIGS. 3-4, aspects of the invention provide additional security over the prior by having a solid piece of door without any openings as shown in FIG. 2. The door 306 includes no attachments other than the lock assembly 308. This design or construction ensures added security to the mailbox 300.

For example, embodiments of the invention may apply to various mail box sizes that are currently available:

TABLE 1

| Exemplary mailbox size dimensions: | | |
|---|---|---|
| Height (inches) | Width (inches) | Depth (inches) |
| 8.375 | 6.375 | 19 |
| 8.75 | 6.75 | 20 |
| 9.5 | 7.875 | 19.375 |
| 9.75 | 6.25 | 3.25 |
| 9.75 | 7.75 | 20.25 |
| 9.75 | 16.75 | 4.625 |
| 10.875 | 8.5 | 22.25 |
| 11.125 | 9 | 21.75 |
| 12.5 | 9.5 | 4 |
| 12.5 | 9.625 | 4.375 |

TABLE 1-continued

| Exemplary mailbox size dimensions: | | |
|---|---|---|
| Height (inches) | Width (inches) | Depth (inches) |
| 21 | 11.5 | 9.5 |
| 21.5 | 10 | 49.5 |

It is to be understood that other mailbox sizes may be used without departing from the scope and spirit of aspect of the invention.

Figure 5:
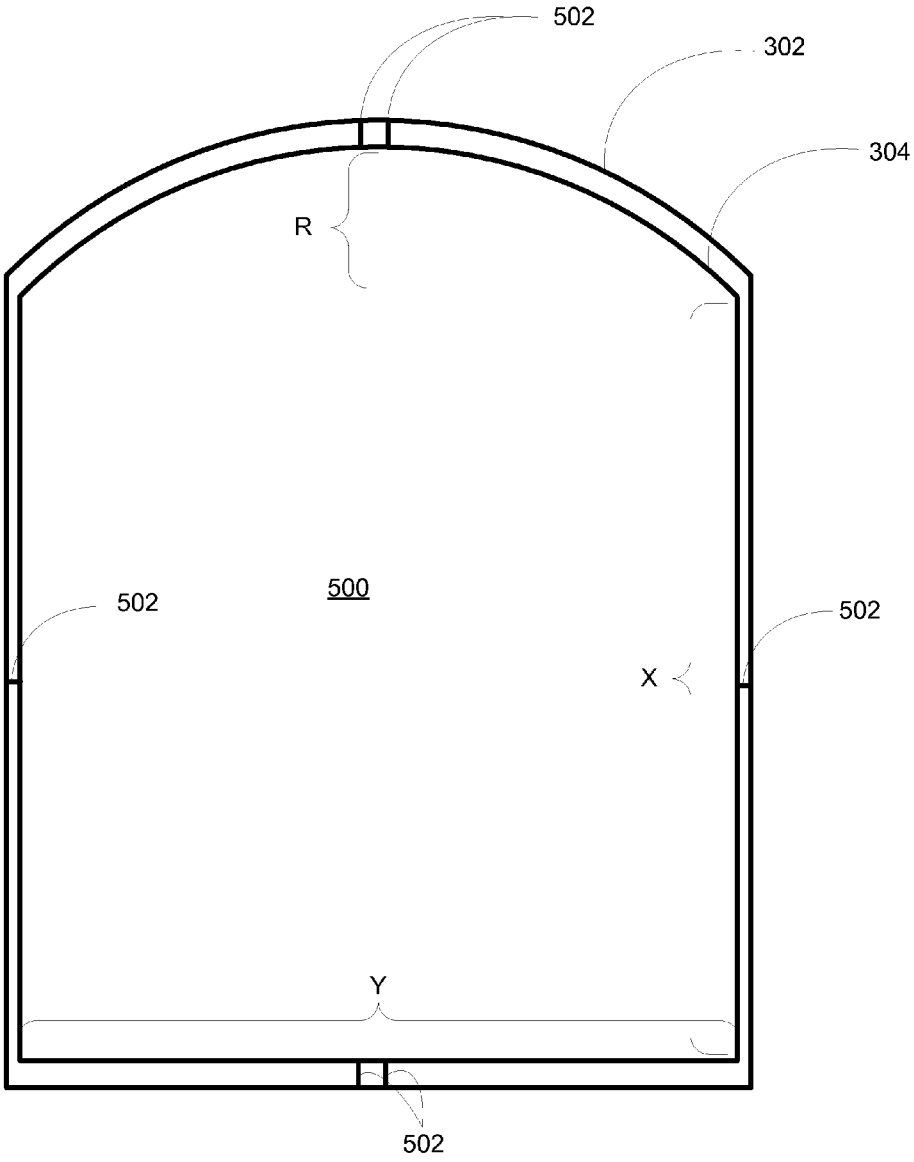
FIG. 5 illustrates a cross-section view of an interior of a mailbox according to one embodiment of the invention.

Referring now to FIG. 5, an illustration of a cross-section view of an interior of a mailbox according to one embodiment of the invention. For example, FIG. 5 illustrates an interior chamber 500 of the lockbox 304 of the housing 302 of the mailbox 300. The interior chamber 500 includes a value of X in inches for a height of the lockbox 304, a value of Y in inches for a width of the lockbox 304, and a radius R in inches for a curve of the lockbox 304. A surface area of the interior chamber 500 is resulted from a calculation of the values of the above. In one example, the door 306 has a surface area as the interior chamber 500. Moreover, based on the illustrated example in FIG. 5, the surface area of the door 306 (thus the interior chamber 500) is smaller than that of the interior chamber of the housing 302 as the lockbox 304 is disposed in the housing 302.

FIG. 5 further illustrates that one or more anchors 502 are used to secure the lockbox 304 in the housing 300. For example, the anchors 502 may include a variety of fasteners, such as adhesives, nuts-bolts combination, etc. It will be apparent that modifications and variations of the different fasteners are possible without departing from the scope and spirit of aspects of the invention as defined in the appended claims. In another embodiment, the anchors 502 also include cushions or washers that may absorb impact by the user when closing the door 306 of the lockbox 304.

Another aspect of the invention further provides a system of a key system for mailboxes, such as the mailbox 300. As discussed above, the door 306 lacks any openings or attachments other than the lock assembly 308. As such, while the door 306 provides added security to the mailbox 300, the door 306 does not provide any means for a mailperson to deliver mail items. As such, in conjunction with embodiments of the invention, aspects of the invention further include a first key and a second key for opening or closing the lock assembly 308 of the lockbox 304. The first key may be a master key to be possessed by a mailperson of the United States Postal Service. The second key may be an individual key or user key to be possessed by an owner of the mailbox 300. While this system may add a complication to the workflow of mail delivery to the mailperson, this key system of the first key and the second key associated with the lockbox 304 will restore confidence in mail delivery and mail reception. In this age of electronic delivery of communications and correspondences, aspects of the invention provide a peace of mind to mailbox owners.

In another embodiment, mail or postal delivery organizations, such as the United States Postal Service, United Postal Service, or Federal Express, may further operate embodiments of the invention as a modern version of "post office boxes." For example, a postal or mail delivery company may provide a lockbox, such as the lockbox 304, for a nominal fee to each household. The postal or mail delivery company then may collect service fees for mail delivery to the mailboxes to households. Because these mailboxes are more secure than usual ones and provide the convenience to households of retrieving mail items conveniently like old mailboxes, the postal or mail delivery company may provide enhanced mail delivery service to households applying aspects of the invention.

Figure 6:
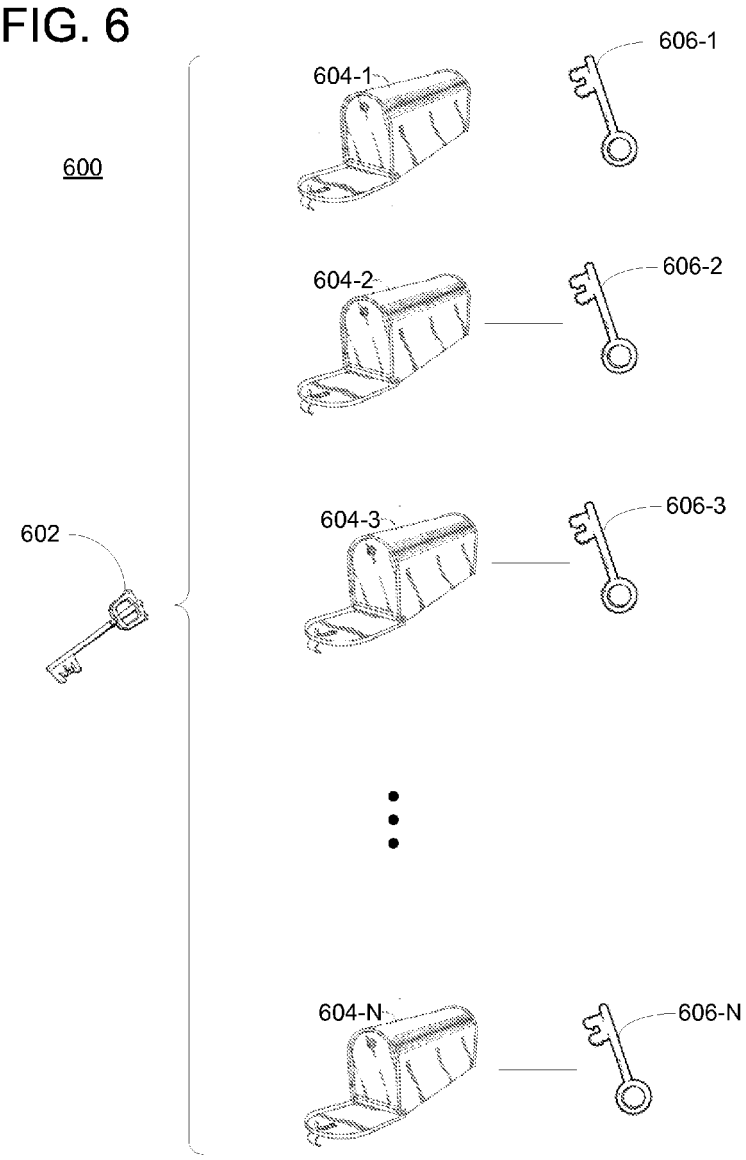
FIG. 6 illustrates a mailbox system according to one embodiment of the invention.

As such, a further embodiment of the invention includes a mailbox system as illustrated in FIG. 6. For example, the mailbox system 600 includes a first key 602, such as a master key for a plurality of mailboxes 604. Each of the mailboxes 604, such as the mailbox 300, includes a lockbox, such as the lockbox 304. Each of the lockboxes is associated with a user key 606. Such user key 606 is to be owned by each owner of the mailbox.

As described above, aspects of the invention include a form of retrofitting lockboxes to existing mailboxes to provide added security. As such, it is to be understood that other applications of these processes such as for initial manufacture of a mailbox are contemplated within the broad scope and spirit of the invention, and need not be limited to retrofit applications employing processes introduced herein.

When introducing elements of aspects of the invention or the embodiments thereof, the articles "a," "an," "the," and "said" are intended to mean that there are one or more of the elements. The terms "comprising," "including," and "having" are intended to be inclusive and mean that there may be additional elements other than the listed elements.

Having described aspects of the invention in detail, it will be apparent that modifications and variations are possible without departing from the scope and spirit of aspects of the invention as defined in the appended claims. As various changes could be made in the above constructions, products, and methods without departing from the scope and spirit of aspects of the invention, it is intended that all matter contained in the above description and shown in the accompanying drawings shall be interpreted as illustrative and not in a limiting sense.

The invention claimed is:

1. A mailbox system comprising:

a mailbox housing having an interior chamber, said interior chamber having a surface area and a depth, said mailbox housing having an exterior door being hingeably coupled to a wall of the mailbox housing;

a lockbox being positioned within and being secured to the interior chamber of the mailbox housing, said lockbox defining a lockbox interior chamber for receiving and storing mail, said lockbox defining an open front end for providing access to the lockbox interior chamber, wherein the lockbox extends substantially the entire height, width and radius of a curvature of the interior chamber of the mailbox housing;

a security door hingeably attached to a wall of the lockbox, said security door having a size covering the entire defined open front end of the lockbox, said security door lacking an opening thereon; and a lock assembly coupled to the security door, said lock assembly configured to alternatively maintain the security door in a closed position or an opened position.

2. The mailbox system of claim 1, further comprising a key system for operably enabling the lock assembly.

3. The mailbox system of claim 2, wherein the key system comprises a master key.

4. The mailbox system of claim 2, wherein the key system comprises a user key.

5. The mailbox system of claim 1, wherein the mailbox housing is disposed on a stand, said stand being placed by curbside.

6. The mailbox system of claim 1, wherein the surface area of the interior chamber of the mailbox comprises about one of the following values in square inch (inch$^2$): 54.00, 59.00, 61.00, 74.80, 75.60, 92.50, 100.20, 118.80, 120.50, 163.40, 215.00, and 241.5.

7. A mailbox system comprising:

a lockbox being positioned within and being secured to an interior chamber of a mailbox housing, said lockbox defining a lockbox interior chamber for receiving and storing mail, said lockbox defining an open front end for providing access to the lockbox interior chamber, wherein the lockbox extends substantially the entire height, width and radius of a curvature of the interior chamber of the mailbox housing;

a security door hingeably attached to a wall of the lockbox, said security door having a size covering the entire defined open front end of the lockbox, said security door lacking an opening thereon;

a lock assembly coupled to the security door, said lock assembly configured to alternatively maintain the security door in a closed position or an opened position;

a first key for enabling the lock assembly; and a second key for enabling the lock assembly.

8. The mailbox system of claim 7, further comprising:

a second lockbox being positioned within and being secured to a second interior chamber of a second mailbox housing, said second lockbox defining a second lockbox interior chamber for receiving and storing mail, said second lockbox defining a second open front end for providing access to the second lockbox interior chamb er, wherein the second lockbox extends substantially the entire height, width and radius of a curvature of the second interior chamber of the second mailbox housing;

a second security door hingeably attached to a wall of the second lockbox, said second security door having a size covering the entire defined second open front end of the interior chamber of the second mailbox housing;

a second lock assembly coupled to the second security door, said second lock assembly configured to alternatively maintain the second security door in a closed position or an opened position; and a third key for enabling the second lock assembly.

9. The mailbox apparatus of claim 8, wherein the first key comprises a master key enabling the second lock assembly.

10. A secure mailbox system comprising:

a plurality of housings, each of said plurality housings having an interior chamber, said interior chamber having a surface area and a depth, each of said plurality of housings having an exterior door, said each of the exterior door being hingeably coupled to a wall of the each of the plurality of housings;

a plurality of lockboxes, each of said plurality of lockboxes being positioned within and being secured to the corresponding interior chamber of each of the plurality of housings, said each of the plurality of lockboxes defining a lockbox interior chamber for receiving and storing mail, said each of the plurality of lockboxes defining an open front end for providing access to the lockbox interior chamber, wherein each of the plurality of lockboxes extends substantially the entire height, width and radius of a curvature of the interior chamber of the each of the plurality of housings;

a plurality of security doors, each of said plurality of security doors hingeably attached to a wall of the each of the plurality lockboxes, said each of the plurality of security doors having a size covering the entire defined open front end of the lockbox, said security door lacking an opening thereon;

a plurality of lock assemblies, each of said plurality of lock assemblies being coupled to the each of the plurality of security doors, said each of said plurality of lock assemblies configured to alternatively maintain the each of the plurality of the security doors in a closed position or an opened position; and a first key for operably enabling the plurality of lock assemblies.

11. The secure mailbox system of claim 10, wherein the exterior door comprises the door without a lock assembly.

* * * * *